US008919392B2

(12) United States Patent
Bullen

(10) Patent No.: US 8,919,392 B2
(45) Date of Patent: Dec. 30, 2014

(54) CONTAINER FILLING ASSEMBLY

(76) Inventor: Lawrence Bullen, Centerburg, OH (US)

( * ) Notice: Subject to any disclaimer, the term of this patent is extended or adjusted under 35 U.S.C. 154(b) by 451 days.

(21) Appl. No.: 13/187,031

(22) Filed: Jul. 20, 2011

(65) Prior Publication Data

US 2012/0186692 A1 Jul. 26, 2012

Related U.S. Application Data

(63) Continuation of application No. 10/572,496, filed as application No. PCT/US2004/030782 on Sep. 21, 2004, now Pat. No. 8,016,003.

(60) Provisional application No. 60/504,828, filed on Sep. 22, 2003.

(51) Int. Cl.
*B65D 1/04* (2006.01)
*B65B 3/00* (2006.01)

(52) U.S. Cl.
CPC ..... *B65B 3/003* (2013.01)
USPC ..... 141/237; 141/59; 141/65; 53/476; 53/477

(58) Field of Classification Search
USPC ..... 141/2, 4–8, 59, 63–67, 234–237; 53/432, 468, 473, 476, 477
See application file for complete search history.

(56) References Cited

U.S. PATENT DOCUMENTS

| | | | | |
|---|---|---|---|---|
| 1,922,458 | A | 8/1933 | Schaeffer | |
| 2,562,815 | A * | 7/1951 | Oscroft | 141/98 |
| 2,957,502 | A * | 10/1960 | Kraft | 141/61 |
| 3,282,306 | A | 11/1966 | Greenhut | |
| 4,036,232 | A * | 7/1977 | Genese | 604/143 |
| 4,099,550 | A | 7/1978 | Matsuzaki et al. | |
| 4,245,655 | A * | 1/1981 | Patel | 600/578 |
| 4,256,152 | A * | 3/1981 | Belanger et al. | 141/70 |
| 4,411,295 | A | 10/1983 | Nutter | |
| 4,501,306 | A * | 2/1985 | Chu et al. | 141/94 |
| 4,713,925 | A | 12/1987 | Kafkis | |
| 5,224,937 | A * | 7/1993 | van der Heiden et al. | 604/200 |
| 5,522,439 | A | 6/1996 | Hakansson et al. | |
| 5,740,845 | A * | 4/1998 | Bonora et al. | 141/292 |
| 5,884,457 | A | 3/1999 | Ortiz et al. | |
| 6,418,982 | B1 | 7/2002 | Zhang et al. | |
| 6,640,842 | B1 | 11/2003 | Laukenmann et al. | |
| 6,644,364 | B1 * | 11/2003 | Feygin | 141/130 |
| 7,150,297 | B2 | 12/2006 | Nussey | |
| 7,341,078 | B1 | 3/2008 | Xia et al. | |

* cited by examiner

*Primary Examiner* — Timothy L Maust
(74) *Attorney, Agent, or Firm* — MacMillan Sobanski & Todd, LLC

(57) ABSTRACT

A container filling assembly includes a plurality of fluid storage containers, and a fluid inlet for supplying a fluid from a fluid source to the containers. A vacuum source creates a vacuum in the containers to draw the fluid into the containers and thereby fill the containers. A connective structure connects the vacuum inlet and the fluid inlet in fluid communication with the containers.

17 Claims, 4 Drawing Sheets

CONTAINER FILLING ASSEMBLY

CROSS-REFERENCE TO RELATED APPLICATION

This application is a continuation of pending U.S. utility application Ser. No. 10/572,496, filed Nov. 16, 2006, which is the National Stage of International Application No. PCT/US2004/030782, filed Sep. 21, 2004, which claims the benefit of U.S. provisional application Ser. No. 60/504,828, filed Sep. 22, 2003.

BACKGROUND OF THE INVENTION

This invention relates in general to apparatuses for filling containers, and in particular to an assembly for filling storage containers such as vials with a fluid such as a drug.

Current methods for filling containers often have certain disadvantages. For example, a supply of a liquid drug is usually divided into portions and aseptically filled into vials for storage. The current technique is to work in a clean room or hood and use a volumetric pipette to measure aliquots into open vials and then seal the vials. This technique is relatively time-consuming and costly. Therefore, it would be desirable to provide an improved way to fill containers such as drug storage vials.

The patent literature does not successfully address this problem. For example, U.S. Pat. No. 5,592,948 to Gatten, issued Jan. 14, 1997, discloses an assembly for filling a single vial with a fluid sample, such as a blood sample. The vial assembly integrates the functions of drawing up of the liquid sample through an inlet tube into a storage chamber, sealing the inlet tube, severing the inlet tube below the seal, identifying the sample for later analysis, and providing sample extraction. Liquid is drawn into the chamber by expanding a collapsed bellows inside the chamber, thereby producing a partial vacuum which draws liquid through the attached inlet tube into the storage chamber. A hot knife sealing shear is then activated to sever the end of the inlet tube from the storage chamber, while simultaneously closing and melting shut the chamber side of the tube.

U.S. Patent Application No. 2002/0025582 A1 to Hubbard et al., published Feb. 28, 2002, discloses a liquid handling system suitable for drug analysis and screening. The system includes a liquid handling substrate having a plurality of channels for conducting a liquid sample in the substrate, where the channels terminate in a plurality of exit ports in an outer surface of the substrate for transfer of a quantity of the liquid sample. The system also includes a liquid storage and dispensing substrate having a plurality of separable cartridges corresponding to the channels. The system enables a method for storing and dispensing liquids including drawing a liquid sample into the channels either by vacuum, capillary action, electroosmotic flow, a minipump or any combination thereof, storing the liquid sample into the cartridge, and dispensing the liquid sample.

SUMMARY OF THE INVENTION

This invention relates to a container filling assembly including a plurality of fluid storage containers, a fluid inlet for supplying the fluid from a fluid source to the containers, a vacuum inlet for connection to a vacuum source which creates a vacuum in the containers to draw the fluid into the containers, and a connective structure for connecting the vacuum source and the fluid source in fluid communication with the containers.

The invention also relates to a sterile, closed container filling assembly including a plurality of pre-sterilized fluid storage containers, a sterile fluid inlet for supplying a sterile fluid to the containers, a sterile vacuum inlet for connection to a sterile vacuum source for creating a vacuum in the containers to draw the fluid into the containers, and a sterile connective structure for connecting the vacuum source and the fluid source in fluid communication with the containers. The containers, the fluid inlet, the vacuum inlet and the connective structure comprise a closed system. The closed system may further include the fluid source and vacuum source.

The invention also relates to a container filling assembly including a plurality of fluid storage containers, the containers having a dispensing location, a fluid source for supplying a fluid to the containers, and a connective structure between the fluid source and a location on the containers that is different from the dispensing location, for filling the containers with the fluid.

The invention also relates to a method of separating a container from a container filling assembly while maintaining the container as a closed system. The invention further relates to a method of separating a container from a container filling assembly while maintaining both the container and the remainder of the container filling assembly as a closed system. The container filling assembly includes a plurality of fluid storage containers, a fluid inlet for supplying a fluid to the containers, and a connective structure for connecting the fluid source to the containers. The method comprises separating the container from the connective structure in a manner that seals the container and the connective structure, when desired, to maintain the remainder of the assembly as a closed system.

Various advantages of this invention will become apparent to those skilled in the art from the following detailed description of the preferred embodiments, when read in light of the accompanying drawings.

DETAILED DESCRIPTION OF THE INVENTION

The container filling assembly of the invention is capable of filling a number of containers with fluid. Preferably, the interiors of the components of the assembly are pre-sterilized and the assembly is a closed system. Keeping the assembly closed during the container filling process maintains sterility within the assembly, thereby reducing the risk of contamination of the fluid.

The container filling assembly includes a plurality of fluid storage containers. The containers can be any type that are suitable for storage of a fluid, and that are recognizable as containers by persons of ordinary skill in the art. For example, channels or similar structures are not considered to be containers. The containers are separate structures, as opposed to passages, chambers or the like in an apparatus. Some nonlimiting examples of fluid storage containers according to the invention include vials, flasks, bottles, and the like. The containers can be used to store any type of fluid, such as pharmaceutical fluids, biological fluids, industrial fluids, or consumer product fluids. In a preferred embodiment, the containers are drug storage vials.

Figure 1:
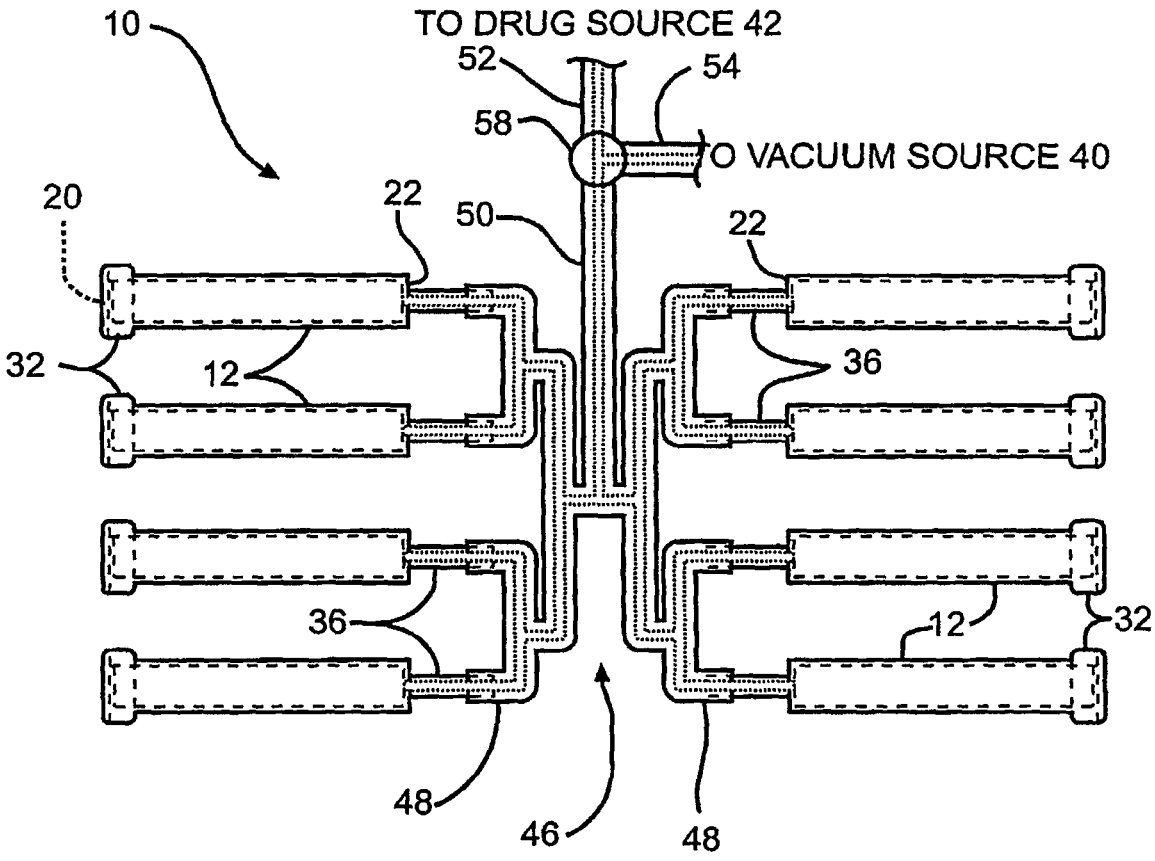
FIG. 1 is a plan view of a container filling assembly according to the invention.

In the embodiment shown in FIG. 1, the container filling assembly is a vial filling assembly 10 including a plurality of fluid storage vials 12. Any suitable number of vials or other containers can be included in the assembly. Typically, the assembly includes at least four vials or other containers, more typically from four to sixteen, and most typically from six to twelve. The assembly 10 shown in FIG. 1 includes eight vials 12, while the assembly 14 shown in FIG. 2 includes ten vials 16 and 18.

The containers can have any suitable size. Preferably, the containers are sized to approximately twice the volume of the fluid they are to hold, e.g., 7 ml if the fluid volume is to be 3.5 ml. The containers in the assembly can have the same volume or different volumes. In the embodiment shown in FIG. 1, the vials 12 have the same volume. In the embodiment shown in FIG. 2, the vials 16 have a smaller volume than the vials 18. Typically for drug storage, the vials have a volume of from about 1 ml to about 20 ml.

Figure 2:
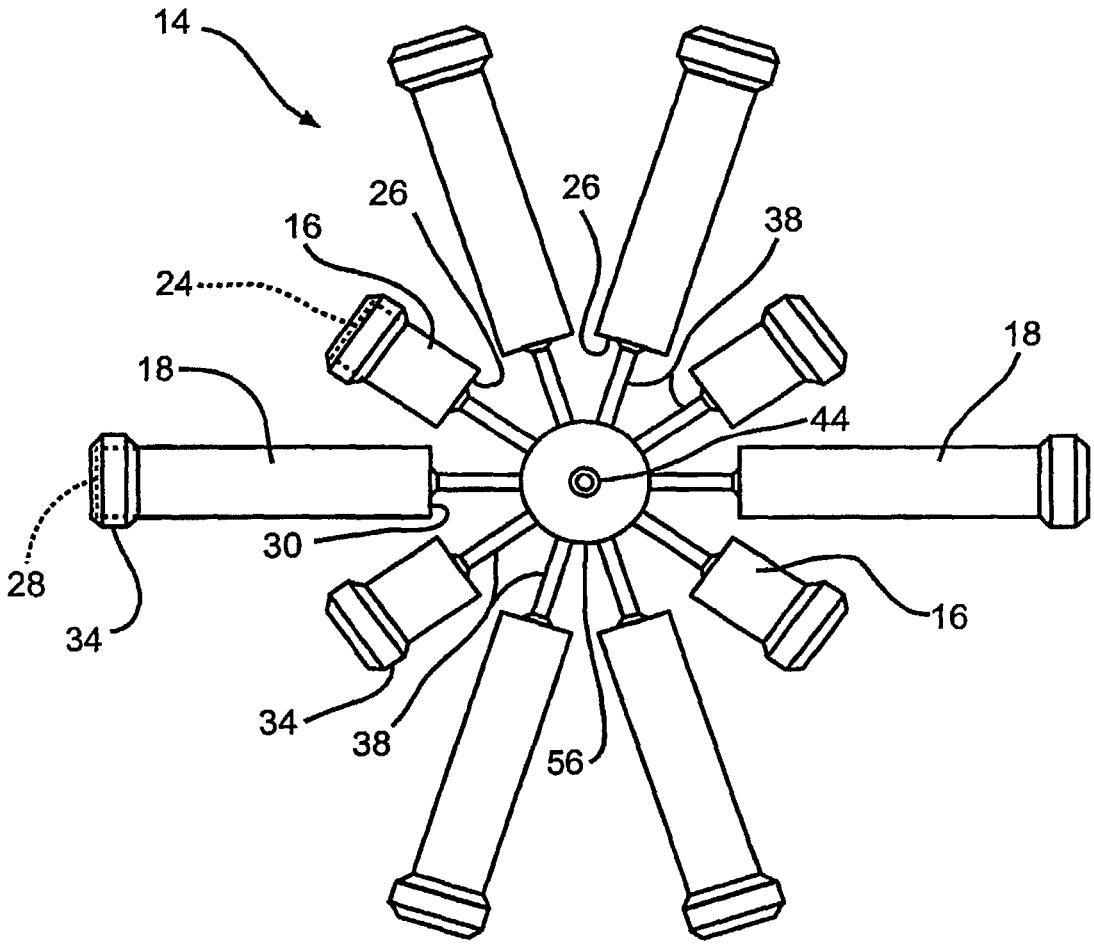
FIG. 2 is a plan view of another embodiment of a container filling assembly according to the invention.

The containers can have any suitable shape, such as the cylindrically-shaped vials shown in FIGS. 1 and 2, or a rounded shape. The containers are made from a relatively rigid material that does not collapse when a vacuum is drawn inside the containers, as discussed below. Any suitable material can be used, such as by way of example and not limitation, glass or a relatively rigid plastic such as polypropylene. Preferably, in many applications the material used to make the containers is chosen to be suitable to the application. Factors for selection include, but are not limited to, the type of fluid or biological material in contact with the container, the medium used in a process, transfer conditions, storage conditions, and conditions of use. It can also be advantageous for the material of the containers to be transparent or translucent to allow viewing of the fluid inside the containers.

In some applications it may be preferred to make containers sufficiently resistant to cold that they can withstand cryogenic storage. For example, a fluid containing live cells can be stored under cryogenic conditions to protect the viability of the cells. In applications requiring cold storage or cryogenic storage, again, a number of materials suitable to the application may be used for the container and septum. However, by way of example and not limitation, it is preferred in accordance with the present invention to use polypropylene containers and Teflon coated rubber septums for biological materials intended for transport or storage at cryogenic temperatures. The materials were found to be effective in maintaining the sterility of the contents of the containers at cryogenic temperatures. Alternatively, for transport and storage at ambient, cold or cryogenic temperatures, screw tops (not shown), may be used to seal the tops of the containers of the present invention; and as a further alternative, particularly for transportation and storage at cold or cryogenic conditions, the tops of containers may be both sealed with a septum and fitted with screw tops that fit over the septum to provide an added level of security to the seal and protect the septum from inadvertent rupture. Such safety precautions may be particularly advantageous where the containers include an aliquot of biological materials or vaccines.

The containers have an opening from which the fluid is dispensed after storage. In the embodiments shown in FIGS. 1 and 2, the vials 12, 16 and 18 have openings 20, 24 and 28, respectively, at the top end of the vial. The containers also have a gas-tight closure that covers the opening at least during the process of filling the container, which is described below. In FIGS. 1, the vials 12 each have a gas-tight closure 32 covering the opening at the top end of the vial, and in FIG. 2 the vials 16 and 18 each have a gas-tight closure 34 covering the opening. The closure can have any construction that is suitable for maintaining a gas-tight seal on the opening, and that can withstand a vacuum that is drawn inside the container during the filling process.

Reference to the "top" or "bottom" of the vial is for convenience only, and may be equally referred to, respectively, as the "first end" or the "second end" of a vial or container in accordance with the present invention.

Figure 3:
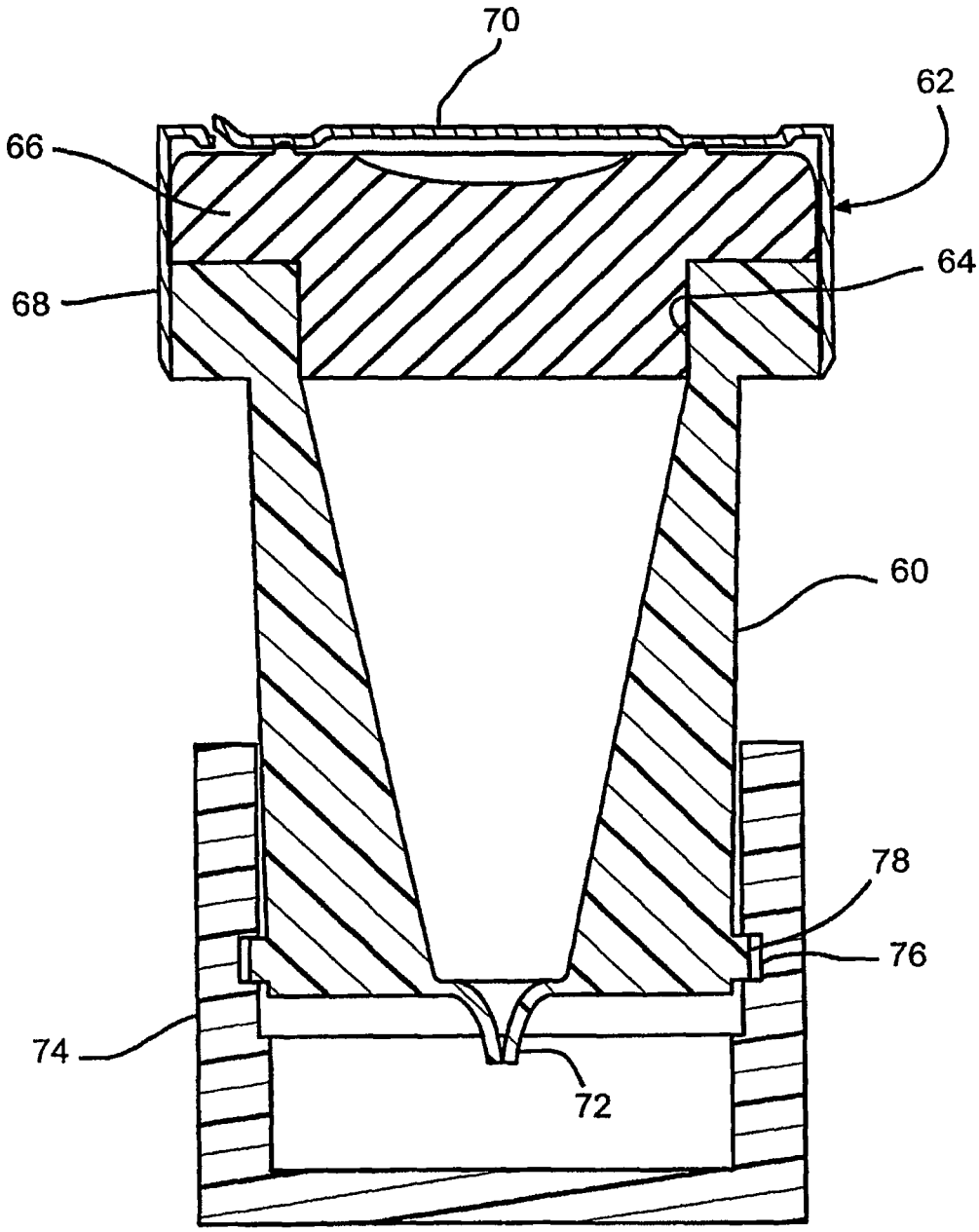
FIG. 3 is a side cross-sectional view of a container and a base for use in the invention.

FIG. 3 shows a vial 60 having a preferred closure 62 according to the invention. The vial has an opening 64 at its top end. The closure includes a septum 66 that sits on the top end of the vial and extends downward to plug the opening, thereby creating a gas-tight seal on the opening. The septum is made from a material such as rubber that is penetrable by a needle; this allows the insertion of the needle through the septum to remove the fluid from the vial while maintaining the closed condition of the vial. The septum may be coated with a corrosion resistant material such as TEFLON® to protect the rubber from the fluid in the vial. The closure also includes a crimp-on seal 68 that is crimped over the top end of the vial and over the septum, to help keep the septum in place. The crimp-on seal includes a top portion 70 that can be peeled back to expose the septum. The crimp-on seal can be made from any suitable material, such as aluminum.

The vial 60 in FIG. 3 includes a fill stem 72 that has been pinched off and sealed, as described below. The fill stem protruding from the bottom of the vial makes it difficult to place the vial in an upright position on a surface. Preferably, a base 74 is provided that cooperates with the vial to allow the vial to stand upright. The illustrated base is a cup-shaped piece made from any suitable material, such as a relatively rigid plastic. The base has a groove 76 that extends around the interior surface of the base. The vial has a ridge 78 that extends around the bottom end of the vial. The bottom portion of the vial is press fit into the base, and the ridge snaps into the groove to retain the vial on the base.

In contrast to previously known containers such as fluid storage vials, the containers of the invention are not filled with fluid at the same location from which the fluid is later dispensed. Instead, the containers are filled with fluid at a location that is different from the dispensing location. In the embodiment shown in FIG. 1, the fluid is dispensed from each vial 12 through the opening 20 at the top end of the vial. However, each vial 12 is filled with fluid through the bottom end 22 of the vial. In FIG. 2, the vials 16 and 18 are filled with fluid through their bottom ends 26 and 30. The bottom end of the vial can have any suitable fill structure for filling the vial with the fluid. The vials 12 shown in FIG. 1 have fill parts in the form of fill stems 36 extending from the bottom end 22 of the vials, and the vials 16 and 18 shown in FIG. 2 have fill stems 38 extending from the bottom ends 26 and 30 of the vials. In the illustrated embodiment, the fill stems are small, hollow tubes made from plastic that are formed integrally with the bottom ends of the plastic vials. The fill stems can be co-molded with the vials or formed by any other suitable method. The fill stems can also be separate pieces that are attached to the bottom of the vials, instead of being formed integrally with the vials. The fill stems lead to small openings in the bottom end of the vials for filling the vials with the fluid. Many other structures of fill parts could be used besides the fill stems. Alternatively, the bottom ends of the vials could be located adjacent to the manifold (described below) for filling the vials, in which case the vials would not require fill parts.

As shown in FIG. 1, the container filling assembly also includes a vacuum inlet and can also include a vacuum source 40. The vacuum source can be any suitable device for drawing air or other gas out of the containers to create a vacuum in the containers. By "vacuum" is meant a complete vacuum or any partial vacuum suitable for drawing the fluid into the containers, as discussed below. Typically, the vacuum source creates a pressure less than atmospheric in the containers, typically between about 200 and 600 mm Hg, more typically about 330 to 430 mm Hg atmosphere, and most typically approximately 380 mm Hg, and may be defined by the application so long as the container or material is not damaged by the extent of evacuation. An example of a device suitable for use as the vacuum source is a pressure controlled vacuum pump, in which the fixed vacuum level and a controlled time of connection regulates the volume of air or other gas evacuated from the containers. The vacuum source can also be a single stroke positive displacement piston, such as a syringe pump, or a single stroke positive displacement diaphragm or bellows. Some of these manual vacuum pumping devices may be added to or incorporated into the assembly for some applications where a power driven vacuum pump is unavailable or impractical or where power is unavailable.

As shown in FIG. 1, the container filling assembly also includes a fluid source 42 (by way of example and not limitation, a drug source (not shown)) connected at a fluid inlet (not shown) which is in fluid communication with second hollow tube 52, valve 58, and first hollow tube 50. The fluid source can be any suitable structure for supplying the desired fluid to the fluid inlet of the assembly, for example a fluid supply vessel containing a liquid vaccine. The fluid source and the vacuum source are not shown in FIG. 2, but they are attached to the input port 44 in the center of the assembly 14. In an alternate configuration, the closed system includes a fluid reservoir attached to the fluid inlet.

The container filling assembly also includes a connective structure for connecting the vacuum source and the fluid source in fluid communication with the containers. The connective structure can be a single component or multiple components cooperating to achieve the desired connections. The structure can include any suitable type of component(s), and the component(s) can have any suitable form. In the embodiment shown in FIG. 1, the connective structure includes a manifold 46 structured for aliquoting the fluid to the plurality of vials. The illustrated manifold consists of a branched hollow tubing structure. The ends of the fill stems 36 of the vials 12 are inserted into the ends of the branches 48 of the manifold and bonded by adhesive. The connective structure also includes a first hollow tube 50 extending from the manifold and in fluid communication with the manifold. In the embodiment shown, the tube 50 is formed integrally with the manifold, but it could also be a separate structure that is attached to the manifold. The connective structure also includes a second hollow tube 52 in fluid communication with the first tube and extending to the fluid inlet and fluid source 42, and a third hollow tube 54 in fluid communication with the first tube and extending to the vacuum inlet and vacuum source 40. The tubes and the manifold can have any structures that are suitable for allowing air or other gas to be drawn from the containers to create the vacuum, and that is suitable for allowing the fluid to be drawn into the containers, as described below. In one embodiment, the manifold and the tubes are both constructed from thick-walled plastic tubing. The tubes may be constructed from a relatively flexible plastic, while the manifold is constructed from a more rigid plastic.

In the embodiment shown in FIG. 2, the connective structure includes a circular disc-shaped manifold 56 for aliquoting the fluid to the plurality of vials. The manifold is constructed from a rigid material such as a rigid plastic. The ends of the fill stems 38 of the vials 16 and 18 are inserted into openings 57 (not shown) around the perimeter of the manifold and bonded by adhesive. The openings lead to radially extending passages (not shown) inside the manifold, which in turn lead to an axially extending central passage (not shown) inside the manifold. The central passage leads to the input port 44. The connective structure also includes connective tubing (not shown) between the input port and the fluid source, and between the input port and the vacuum source. The tubing may be similar to that shown in FIG. 1, consisting of a first tube extending from the input port and second and third tubes branching from the first tube to the fluid source and the vacuum source, respectively.

Preferably, the container filling assembly also includes a mechanism for opening and closing the connection between the vacuum source and the containers, and between the fluid source and the containers. The mechanism can include a single device or multiple devices to open and close the connections. Any suitable device(s) can be used for this purpose. In the embodiment shown in FIG. 1, the mechanism consists of a valve 58 that performs these functions. The valve is located at the intersection of the first tube 50, the second tube 52 and the third tube 54. Any suitable type of valve can be used for this purpose. In one embodiment, the valve is a three-way valve having a first position in which the vacuum source is connected to the containers while the fluid source is disconnected, a second position in which the fluid source is connected to the containers while the vacuum source is disconnected, and a third (off) position in which both the vacuum source and the fluid source are disconnected from the containers. Alternatively, the valve could be a two-way valve that does not include the off position. The container filling assembly of FIG. 2 may have a similar valve (not shown) for performing these functions.

In some embodiments, the components of the container filling assembly are pre-sterilized so that the fluid is dispensed into the containers in a sterile condition. Keeping the assembly as a closed system during the container filling process helps to maintain sterility. Suitable connections and other components can be used to maintain the closed system. For example, SCD compatible tubing can be used for connecting the fluid source to the fluid inlet or manifold. An SCD tubing welder can be used to make connections. The manifold can be connected to the vacuum source through a gas filter having a filter medium that is sufficiently small (e.g., approximately 0.2 micron) to allow a gas such as air to pass through the filter but not contaminants. Thus, gas can escape from or enter the container filling assembly through the gas filter but sterility of the assembly is maintained. A pre-sterilized valve suitable for maintaining the sterility of the closed system can be used at the intersections of the tubes. The use of a sterile, closed assembly eliminates the need to work in a clean environment and avoids exposing operators to potentially hazardous fluids.

In operation, the vacuum source is turned on and the valve is switched so that the containers are connected to the vacuum source. This creates a vacuum inside the containers. After the internal pressure in the containers has had time to equalize, the valve is changed, disconnecting the vacuum source and connecting the fluid source. The fluid is drawn in through the fluid inlet and manifold, and into each container until the internal pressure has returned to one atmosphere. This procedure typically fills the containers approximately one-half full. The fluid fills the containers substantially in proportion to the volume of each container.

The container filling method of the invention is rapid, usually faster than manual pipetting. The method can be automated. It allows uniform filling of multiple containers from a single supply container. The method can be used to dispense differing volumes of fluid into different sized containers (e.g., 5 ml into container A, 10 ml into container B, etc.) in an aseptic system. The method is usually lower cost than manual pipetting.

The invention also includes a method of separating the containers from the connective structure (e.g., the manifold) after they have been filled with the fluid. Preferably, the containers are separated in a manner that maintains the closed nature of the containers and the remainder of the assembly. In a preferred embodiment, a separation method is used that simultaneously separates the containers from the connective structure, and seals both the containers and the connective structure. Any suitable method and apparatus can be used. When the containers and the connective structure are made from plastic, some examples of separation methods that can be used include ultrasonic separation, heat separation, and mechanical crimp separation.

Figure 4:
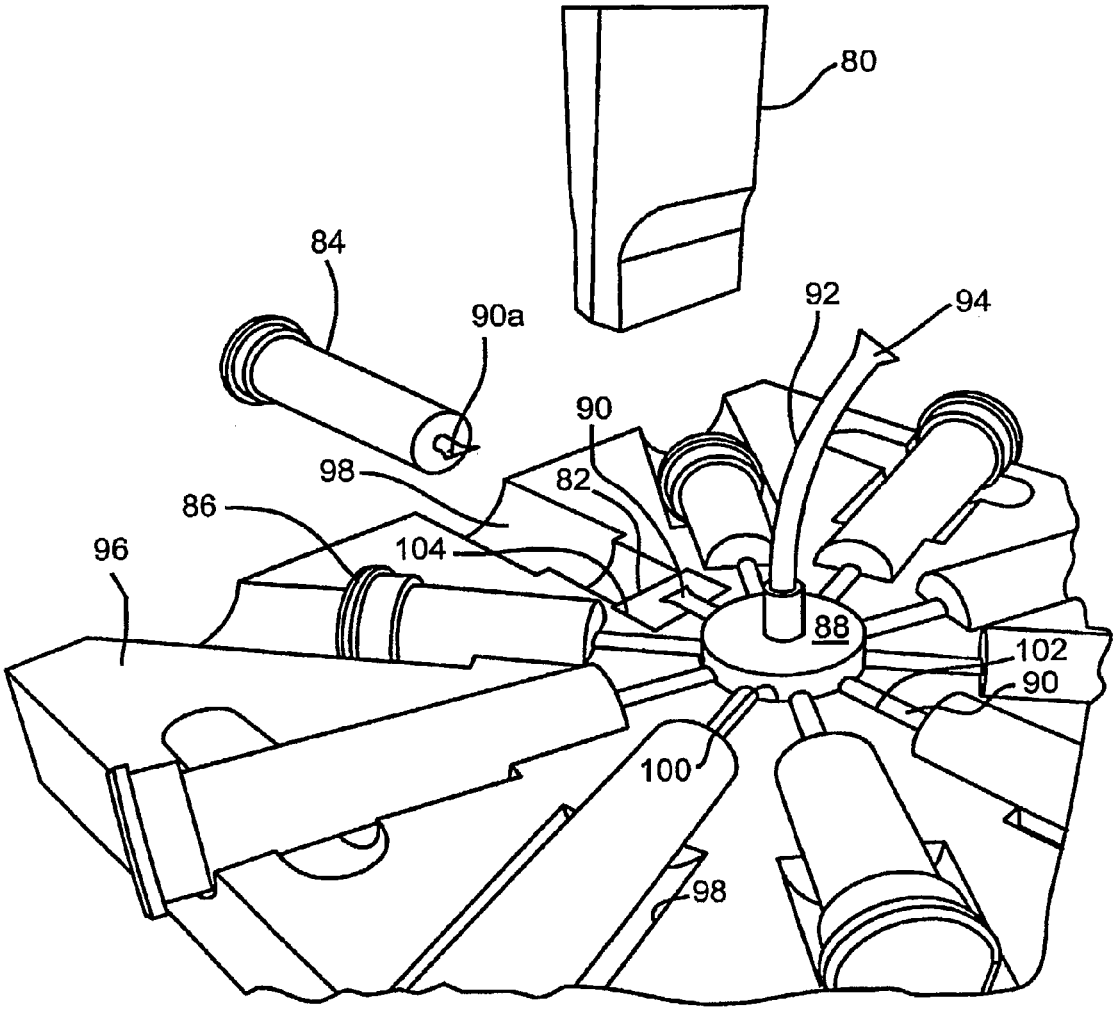
FIG. 4 is a perspective view of a method of separating the filled containers from the manifold of the assembly.

FIG. 4 illustrates a preferred embodiment of a method of separating the containers from the connective structure. The method uses an ultrasonic horn 80 and an ultrasonic anvil 82 to separate the vials 84 and 86 from the manifold 88. The horn and anvil oppose each other, and they are both part of an ultrasonic welding machine (not shown). The anvil is positioned below the fill stem 90 of the vial 84. The horn is ultrasonically vibrated and lowered onto the fill stem and the anvil. The horn pinches off or cuts off the fill stem in a manner that separates the container from the manifold, while simultaneously sealing the end of the fill stem portion 90 that remains attached to the manifold, and sealing the end of the fill stem portion 90*a* that is attached to the bottom of the vial. The seals created are gas-tight seals that maintain the closed nature of both the container and the manifold. Alternatively, the horn can pinch the fill stem in a manner that does not separate the vial, but that creates the seal and imprints a manual cut line on the seal for later separation of the vial.

To facilitate the separation of the vials 84 and 86 from the manifold 88, the connective tubing 92 leading to the manifold has been cut off from the remainder of the vial filling assembly. The end 94 of the tubing has been pinched shut to seal the tubing. Any suitable apparatus/method can be used to cut and seal the tubing. For example, any of the above-mentioned separation methods can be used. One option is to use a Sebra tube sealer (Sebra Corp., Tucson, Ariz.), which uses a combination of mechanical crimping and heat to cut and seal the tube.

In the preferred embodiment shown in FIG. 4, a fixture or nesting device 96 is also used to facilitate the separation of the vials from the manifold. The nesting device interfaces with the vial filling assembly, properly locating the assembly and holding it in place during the separation process. The nesting device has pockets 98 for holding the vials 84 and 86, a pocket 100 for holding the manifold 88, and grooves 102 for holding the fill stems 90. The nesting device also has an opening 104 into which the ultrasonic anvil 82 can be extended. The nesting device is secured to the base of the ultrasonic welding machine.

In operation, a vial is separated from the manifold with the ultrasonic horn and anvil. The horn and anvil oppose each other and pinch the fill stem of the vial as ultrasonic energy is applied. The horn and anvil are shaped to control the flow of the heated plastic fill stem to create gas-tight seals on the ends of the separated stem portions. The nesting device assures correct positioning of the vial and the fill stem during the separation process to provide an effective separation and seal. After the first vial is separated, the remaining assembly is indexed within the stationary nesting device to place the fill stem of the next vial in position between the horn and anvil. Alternatively, the nesting device could include openings for the anvil at all the vial positions, and the nesting device could be indexed. Another alternative would be to use multiple ultrasonic horns and anvils.

Test Results

The container filling method of the invention was tested as follows. Tests 1 and 2 used four vials each. The vials held 5 ml and have a luer fitting glued to the bottom to simulate the filling stem. The manifold was simulated by an assembly of tees and luer fittings. The fluid supply reservoir was simulated by a plastic bag equipped with luer fitting connectors. The fluid supply was connected to the manifold through a three way valve. The third port on the valve was connected to the vacuum source.

The objective of this test was to fill the vials to 2.5 ml level. Ten ml of water was injected into the plastic bag by means of a syringe and the bag was hung such that the port connected to the manifold system was low. The vacuum pump was started and the vacuum level adjusted. The valve was opened to connect the manifold to the vacuum and left for a few seconds. The valve was then switched to disconnect the vacuum and connect the vaccine source to the manifold. The following table shows the resulting fill levels in the four vials.

| | Fill level (ml) in 5 ml vial | | | | |
|---|---|---|---|---|---|
| | Vacuum Level (in mm Hg) | Vial 1 | Vial 2 | Vial 3 | Vial 4 |
| Test 1 | 16 | 1.83 | 1.84 | 1.82 | 1.83 |
| Test 2 | 20 | 2.33 | 2.32 | 2.24 | 2.30 |

Test 3 used the same procedure except that the manifold was expanded to accept 8 vials and 20 ml of water was used. The following table shows the results of test 3.

| | Fill level (ml) in 5 ml vial | | | | |
|---|---|---|---|---|---|
| | Vacuum Level (in Hg) | Vial 1 | Vial 2 | Vial 3 | Vial 4 |
| Test 3 | 16 | 2.53 | 2.56 | 2.59 | 2.49 |
| | | Vial 5 | Vial 6 | Vial 7 | Vial 8 |
| | | 2.52 | 2.45 | 2.42 | 2.43 |

In accordance with the provisions of the patent statutes, the principle and mode of operation of this invention have been explained and illustrated in its preferred embodiments. However, it must be understood that this invention may be practiced otherwise than as specifically explained and illustrated without departing from its spirit or scope.

What is claimed is:

1. A container assembly comprising:

a manifold having a fluid inlet;

a plurality of fluid storage containers which are vials, flasks or bottles, the containers each including a first end adapted for dispensing fluid and a second end at a different location of the container from the first end, the second end having a fill port adapted for fluid flow into the container;

wherein the manifold and the containers are fixed relative to each other, and wherein the fill ports of the containers are connected to the manifold such that fluid flows to the containers in an amount proportional to the container volumes under conditions when the assembly is in a partially evacuated state and fluid is supplied to the fluid inlet.

2. An assembly according to claim 1 wherein one or more of the containers are at their second end, severable from the manifold and sealable.

3. An assembly according to claim 1 wherein some of the containers have volumes that are different from volumes of others of the containers.

4. An assembly according to claim 1 wherein the assembly is adapted to fill the containers approximately one-half full.

5. An assembly according to claim 1 wherein the first end of the containers is the top end in normal use, and the second end of the containers is the bottom end in normal use.

6. An assembly according to claim 1 wherein the manifold and the containers are constructed from plastic.

7. An assembly according to claim 1 wherein the containers have an opening at their first end, and the assembly further includes gas-tight seals in the openings of the containers.

8. An assembly according to claim 1 wherein the assembly further includes a three-way valve having a first position connecting the manifold to a fluid source, a second position connecting the manifold to a vacuum source, and a third position wherein the manifold is disconnected from both the fluid source and the vacuum source.

9. An assembly according to claim 1 wherein the assembly includes at least four fluid storage containers.

10. An assembly according to claim 1 wherein the fluid storage containers are drug storage vials having a volume of from about 1 ml to about 20 ml.

11. An assembly according to claim 1 wherein the assembly is a closed system.

12. An assembly according to claim 1 wherein the assembly is sterile and one or more of the containers are severable from the connective structure and sealable when severed, whereby the containers may be severed and separated from the manifold in sterile condition.

13. An assembly according to claim 1 wherein the assembly further includes a vacuum source attached to the manifold for creating at least a partial vacuum in the manifold and the fluid storage containers.

14. An assembly according to claim 13 wherein the assembly is sterile and closed, the fluid storage containers are sterilized fluid storage vials, the fluid inlet is sterile, the vacuum source is sterile, the manifold is sterile, and the vials, the fluid inlet, the vacuum source and the manifold comprise a closed system.

15. An assembly according to claim 1 wherein the containers are bonded with adhesive to the manifold.

16. An assembly according to claim 15 wherein the containers include fill stems in fluid communication with the fill ports, the fill stems being bonded with adhesive to the manifold.

17. An assembly according to claim 1 wherein the assembly is sterile and the assembly is a closed system.

* * * * *

UNITED STATES PATENT AND TRADEMARK OFFICE

CERTIFICATE OF CORRECTION

PATENT NO. : 8,919,392 B2
APPLICATION NO. : 13/187031
DATED : December 30, 2014
INVENTOR(S) : Lawrence Bullen It is certified that error appears in the above-identified patent and that said Letters Patent is hereby corrected as shown below:

On the Title page,

Delete Item "(76)" Inventor and insert Item --(75)--

Please correct Item (73) by inserting the following information:

--Assignee: Battelle Memorial Institute, Columbus OH (US)--

Signed and Sealed this
Fifth Day of May, 2015

Michelle K. Lee

Michelle K. Lee
*Director of the United States Patent and Trademark Office*